United States Patent [19]

Flatt

[11] 4,099,155

[45] Jul. 4, 1978

[54] GAS ACTUATED HIGH VOLTAGE BUSHING

[75] Inventor: Richard P. Flatt, Oconomowoc, Wis.

[73] Assignee: RTE Corporation, Waukesha, Wis.

[21] Appl. No.: 740,375

[22] Filed: Nov. 10, 1976

[51] Int. Cl.[2] ..... H01H 85/14

[52] U.S. Cl. ..... 337/249; 337/281; 337/409

[58] Field of Search ..... 337/169, 148, 168, 407–409, 337/170, 171, 173, 413, 201, 250, 249, 203, 281, 202

[56] References Cited

U.S. PATENT DOCUMENTS

| | | | |
|---|---|---|---|
| 2,934,628 | 4/1960 | Massar et al. | 337/409 |
| 3,118,986 | 1/1964 | Lewis et al. | 337/409 X |
| 3,120,591 | 2/1964 | Lewis et al. | 337/409 X |
| 3,265,838 | 8/1966 | Ackermann | 337/169 |
| 3,500,279 | 3/1970 | Malaspina | 337/413 |

*Primary Examiner*—George Harris
*Attorney, Agent, or Firm*—Ronald E. Barry

[57] ABSTRACT

An electrical connector system including a cable terminator having a conductive probe and a bushing having a bore contact mounted for reciprocal movement in an electrically conductive tubular member and a fusible member positioned between the bore contact and the conductive member, the fusible member being connected to fuse in response to fault current produced by a prestrike arc to increase the pressure within the tubular member to force the bore contact into electrical engagement with the probe in the terminator.

9 Claims, 2 Drawing Figures

GAS ACTUATED HIGH VOLTAGE BUSHING

BACKGROUND OF THE INVENTION

Gas actuated high voltage bushings have a bore contact mounted for reciprocal movement within a bushing housing. The bore contact moves in response to the expansion of gases generated from the heat of the prestrike arc on close-in of a rod contact with the bore contact. Movement of the bore contact, therefore, depends upon the generation of sufficient gas to fill the bushing at a pressure high enough to move the bore contact into contact with the rod contact. This requires a large volume of gas since the entire bushing interior must be filled.

SUMMARY OF THE INVENTION

The gas actuated high voltage bushing of the present invention provides an independent source of gas pressure which is confined within a small space at the end of the bore contact to assure a rapid response to a fault current condition. The bushing includes a snuffer-contact assembly mounted for reciprocal movement within a conductive cylinder located within the bushing housing. A piston head is provided at one end of the assembly which is spaced a short distance from the end of the conductive cylinder. The piston head is connected to the end of the cylinder by a fusible section or rod which will withstand normal load currents but will fuse under fault current conditions. An arcing ring is provided in the snuffer-contact assembly which is connected directly to the fusible section so that the current produced by a prestrike arc will always flow through the fusible section. Whenever the fusible section fuses as a result of a prestrike arc, a rapid gas build up will occur in the small space at the end of the cylinder which will act against the piston head to move the snuffer-contact assembly toward the terminator.

DRAWINGS

FIG. 1 is a section view of the bushing and terminator according to the invention with the snuffer-contact assembly in the normal position on close-in;

DESCRIPTION OF THE INVENTION

Figure 1:
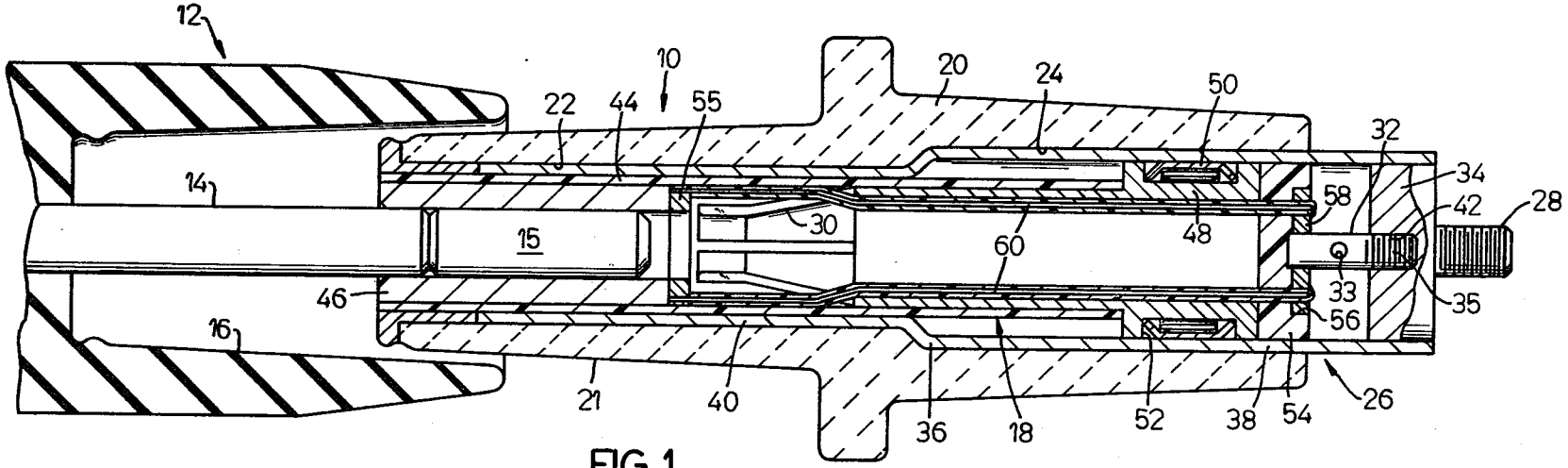
Figure 2:
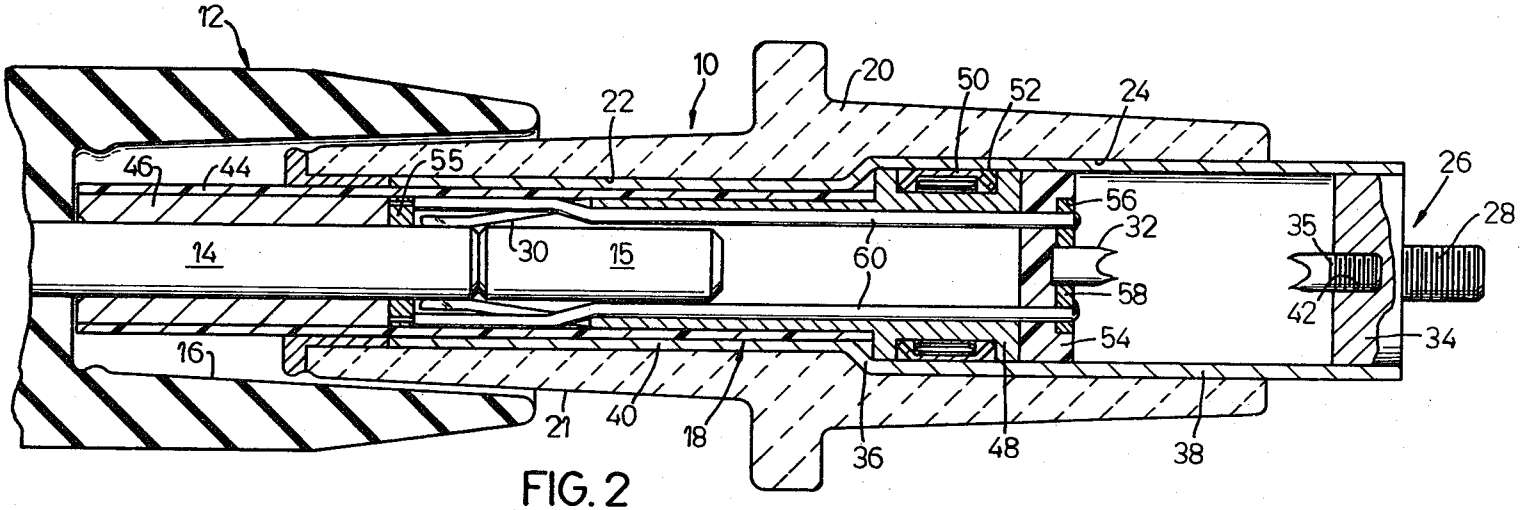
FIG. 2 is a view similar to FIG. 1 showing the snuffer-contact assembly in the fault close position.

The high voltage bushing 10 according to the present invention is used in combination with a terminator 12 to electrically connect a high voltage cable with an electrical device. The terminator 12 includes a probe or rod contact 14 positioned in a tapered recess 16 and an arc follower 15 mounted on the end of the probe 14. Electrical connection is made by inserting the probe 14 and arc follower 15 into an arc snuffer bore contact assembly 18 provided within the bushing 10.

More particularly, the bushing 10 includes a housing 20 which is tapered at 21 to matingly engage the inside surface of the tapered recess 16 in the cable terminator 12. An axially extending bore 22 is provided in one end of the housing 20 and an enlarged bore 24 is provided at the other end. A conductive cylinder assembly 26 is mounted within the housing 20 and is adapted to be connected to an electrical device by a conductive stud 28.

The snuffer-contact assembly 18 is mounted for reciprocal movement within the cylinder assembly 26 from a first or normal position to a second or fault close position. Means are provided for moving the snuffer-contact assembly 18 from the first position to the fault close position. Such means is in the form of a fusible member 32 which increases the pressure of the gas within the cylinder assembly 26 on fusing and forces the assembly 18 toward the fault close position.

The conductive cylinder assembly 26 includes an electrically conductive tubular member 36 having an enlarged cylindrical section 38 positioned in the bore 24 and a small cylindrical section 40 positioned in bore 22. The section 38 is closed at the open end by means of a conductive cap 34. The stud 28 is connected to the opposite side of the cap 34.

The snuffer-contact assembly 18 includes a non-conductive tubular member 44 formed from a glass reinforced plastic and having an arc snuffer or sleeve 46 at one end, a bore contact 30 mounted in the other end and an arcing ring 55 between the snuffer 46 and contact 30. The bore contact 30 includes a piston head 48 having a diameter equal to the inside diameter of the cylindrical section 38 of the member 36. Means are provided for electrically connecting the bore contact 30 to the cylinder 36. Such means is in the form of a louvered band or current interchange member 50 positioned in an annular groove 52 provided in the piston head 48.

The arcing ring 55 is formed of a conductive material such as copper tungsten. The ring 55 is located in front of the bore contact to receive the prestrike arc on close-in of the probe with the bore contact. The open end of the bore contact 30 is closed by means of an insulating disc 54 which is secured to the end of the piston head 48. A recess 56 is provided in the face of the disc 54. The disc 54 has an outer diameter substantially equal to the inner diameter of the cylindrical section 38 to form the face for the piston head 48, the disc 54 being spaced a short distance from the cap 34 when the snuffer-contact assembly 18 is in the first or normal position in the bushing.

Means are provided in the space between the disc 54 and the end cap 34 for generating gas under fault current conditions. Such means is in the form of the fusible member 32 which includes a small hole 33 intermediate the ends to reduce the cross sectional area of the member. The fusible member 32 is connected to the conductive cap 34 by any means such as a threaded section 35 provided on the member 32 which is threaded into a threaded bore 42 in the conductive cap 34. The other end of the fusible member 32 is connected to a conductive disc 58 provided in the recess 56 in the insulating disc 54. The conductive disc 58 is electrically connected to the arcing ring 55 by means of insulated wires 60.

It should be noted that on close-in of the probe 14 with the bore contact 30 the prestrike arc will occur between the probe 14 and the arcing ring 55. The current flow resulting from the establishment of the prestrike arc will always be conducted through the fusible section 32. If this current flow is of sufficient magnitude to fuse the reduced cross sectional area of the fusible section 32, the gases generated in the space between the disc 54 and the cap 34 will expand forcing the snuffer-contact assembly 18 to move rapidly toward the probe 14 to connect the bore contact with the probe 14 and extinguish the arc.

The embodiments of the invention in which an exclusive property or privelege is claimed are defined as follows:

1. A gas-actuated high voltage bushing comprising:
a dielectric housing, a bore contact, an electrically conductive member in said housing supporting said bore contact for axial movement in said housing, fusible means in said housing connected to said bore contact and to said conductive member, and electrically conductive means carried by said bore contact for conducting normal current flow around said fusible means to said conductive member, said fusible means fusing in response to fault current flow for increasing the pressure within said housing to move said bore contact axially in said bushing.

2. The bushing according to claim 1 wherein said conductive member comprises a cylinder having one end closed, said bore contact being mounted in said cylinder and including a piston head spaced from the closed end of said cylinder and said fusible means being connected between the piston head and the closed end of the cylinder.

3. The bushing according to claim 1 wherein said fusible means comprises a member formed of a conductive material and having a reduced cross-section intermediate the ends.

4. The bushing according to claim 2 wherein said bore contact includes an insulating disc on the end of the piston head and a conductive disc embedded within said insulating disc, said fusible means being connected to said conductive disc and said conductive member, and said conductive means being connected to said disc for conducting the prestrike arc current to said disc.

5. The bushing according to claim 1 including an electrically conductive arcing ring in said housing and means for connecting said arcing ring to said fusible means whereby said fault current produced by the prestrike arc will be conducted to said fusible means.

6. In an electrical connector system, the combination of:

a bushing having a snuffer-contact assembly mounted for movement in response to an increase in pressure within said bushing, and a terminator having a probe for engaging and disengaging the snuffer-contact assembly, the improvement comprising:

a fusible means within said bushing, an arcing ring in said snuffer-contact assembly, and means for connecting said arcing ring to said fusible means to conduct prestrike arc current to said fusible means whereby said fusible means will fuse under fault current conditions causing said snuffer-contact assembly to move relative to said housing toward said probe.

7. A high voltage bushing for connecting an electrical device to a high voltage cable terminator having a probe contact,:

the bushing comprising a housing, a snuffer-contact assembly, electrically conductive means in said housing for supporting said snuffer-contact assembly for movement within said housing, a fusible member within the bushing connected to said snuffer contact assembly and said conductive means, and conductor means connected to said fusible member and carried by said snuffer-contact assembly in a position to respond to current flow from the prestrike arc on close-in, said fusible member fusing under fault current conditions and increasing the pressure within said bushing to move said snuffer-contact assembly into engagement with said probe.

8. The bushing according to claim 7 including an arcing ring in said snuffer-contact assembly, and said conductor means connecting said arcing ring to said fusible member whereby said fusible member will fuse whenever a fault current occurs in close-in.

9. A high voltage bushing comprising:

an elastomeric housing having an axial bore, a conductive sleeve mounted in said bore, a conductive cap closing one end of said sleeve, an insulating tube telescopically positioned within said conductive sleeve, an electrically conductive bore contact supported within said tube, said bore contact including a piston head on one end positioned in a spaced relation to said conductive cap, an insulating disc mounted on said piston head, a conductive disc mounted on said insulating disc, a fusible member connecting said conductive disc to said conductive cap, a conductive ring mounted in said tube in a spaced relation to said bore contact, and means electrically connecting said conductive ring to said conductive disc, whereby current flow to said ring will flow through said fusible member.

* * * * *